US010027064B2

(12) United States Patent
Hu et al.

(10) Patent No.: US 10,027,064 B2
(45) Date of Patent: Jul. 17, 2018

(54) ELECTRICAL CONNECTOR

(71) Applicant: FOXCONN INTERCONNECT TECHNOLOGY LIMITED, Grand Cayman (KY)

(72) Inventors: Jian-Long Hu, Kunshan (CN); Dao-Zhen Bian, Kunshan (CN); Shu-Jian Wang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/635,231

(22) Filed: Jun. 28, 2017

(65) Prior Publication Data

US 2017/0373444 A1 Dec. 28, 2017

(30) Foreign Application Priority Data

Jun. 28, 2016 (CN) ..... 2016 2 0653300 U

(51) Int. Cl.

*H01R 13/648* (2006.01)
*H01R 13/6583* (2011.01)
*H01R 24/60* (2011.01)
*H01R 107/00* (2006.01)

(52) U.S. Cl.

CPC ..... *H01R 13/6583* (2013.01); *H01R 24/60* (2013.01); *H01R 2107/00* (2013.01)

(58) Field of Classification Search

CPC ..... H01R 23/7073; H01R 23/725; H01R 23/6873; H01R 13/658
USPC ..... 439/660, 607.35
See application file for complete search history.

(56) References Cited

U.S. PATENT DOCUMENTS 7,097,507 B1 * 8/2006 Zhang ..... H01R 13/6582 439/607.35
8,444,439 B2 * 5/2013 Cao ..... H01R 13/514 439/108
8,636,544 B1 * 1/2014 Briant ..... H01R 13/658 439/607.25
8,724,343 B2 * 5/2014 Feldstein ..... H05K 9/0058 361/616

FOREIGN PATENT DOCUMENTS

CN 202127132 U 1/2012
TW M256011 1/2005

* cited by examiner

*Primary Examiner* — Hien Vu
(74) *Attorney, Agent, or Firm* — Wei Te Chung; Ming Chieh Chang

(57) ABSTRACT

An electrical connector includes an insulative housing enclosing a plurality of terminals and enclosed within a metallic shell. The shell forms a receiving cavity in which said housing is retained. The shell includes opposite top and bottom plates with a plurality of spring tangs split therefrom and extending into the receiving cavity. A top extension unitarily extends rearwardly from a front edge of the top plate and includes a front stationary base section intimately positioned upon the top plate, and a rear deflectable section including a plurality of spring fingers rearwardly extending from a rear end of the front base section in an oblique manner away from the top plate. The front base section forms a plurality of openings corresponding to free ends of the spring tangs for accommodating the corresponding free ends, respectively.

8 Claims, 8 Drawing Sheets

ELECTRICAL CONNECTOR

BACKGROUND OF THE DISCLOSURE

1. Field of the Disclosure

The present disclosure relates to an electrical connector, and particularly to an electrical connector equipped with a metallic shell for coupling to the enclosure of an electrical device.

2. Description of Related Arts

As disclosed in China patent No. 202127132, an electrical connector includes an insulative housing, a plurality of terminals disposed in the housing, and a metallic shell enclosing the housing. The shell forms a receiving cavity wherein one side plate of the shell forms a first spring tang extending inward into the receiving cavity, and a second spring tang extends outward away from the receiving cavity for engagement with an enclosure for EMI (Electromagnetic interference) shielding. Anyhow, in the high speed high frequency transmission of the modern world, such a simple EMI shielding structure may not satisfy the requirements.

An improved electrical connector is desired.

SUMMARY OF THE DISCLOSURE

Accordingly, an object of the present disclosure is to provide an electrical connector with the efficient EMI shielding effect.

To achieve the above object, an electrical connector includes an insulative housing enclosing a plurality of terminals and enclosed within a metallic shell. The shell forms a receiving cavity in which said housing is retained. The shell includes opposite top and bottom plates with a plurality of spring tangs split therefrom and extending into the receiving cavity. A top extension unitarily extends rearwardly from a front edge of the top plate and includes a front stationary base section intimately positioned upon the top plate, and a rear deflectable section including a plurality of spring fingers rearwardly extending from a rear end of the front base section in an oblique manner away from the top plate. The front base section forms a plurality of openings corresponding to free ends of the spring tangs for accommodating the corresponding free ends, respectively. The shell further includes a bottom extension unitarily extends backwardly from a front edge of the bottom plate. The bottom extension forms a plurality of spring fingers having corresponding roots spaced from the front edge of the bottom plate with a distance in the vertical direction.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
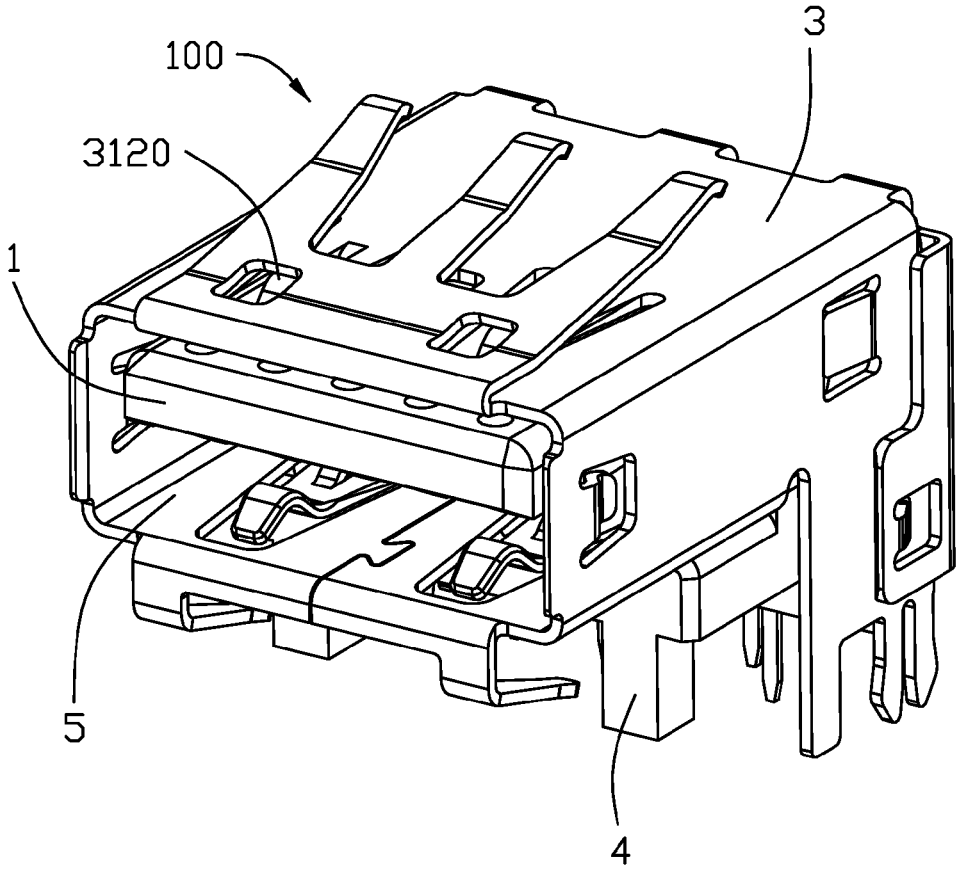
FIG. 1 is a perspective view of an electrical connector of the invention.
Figure 2:
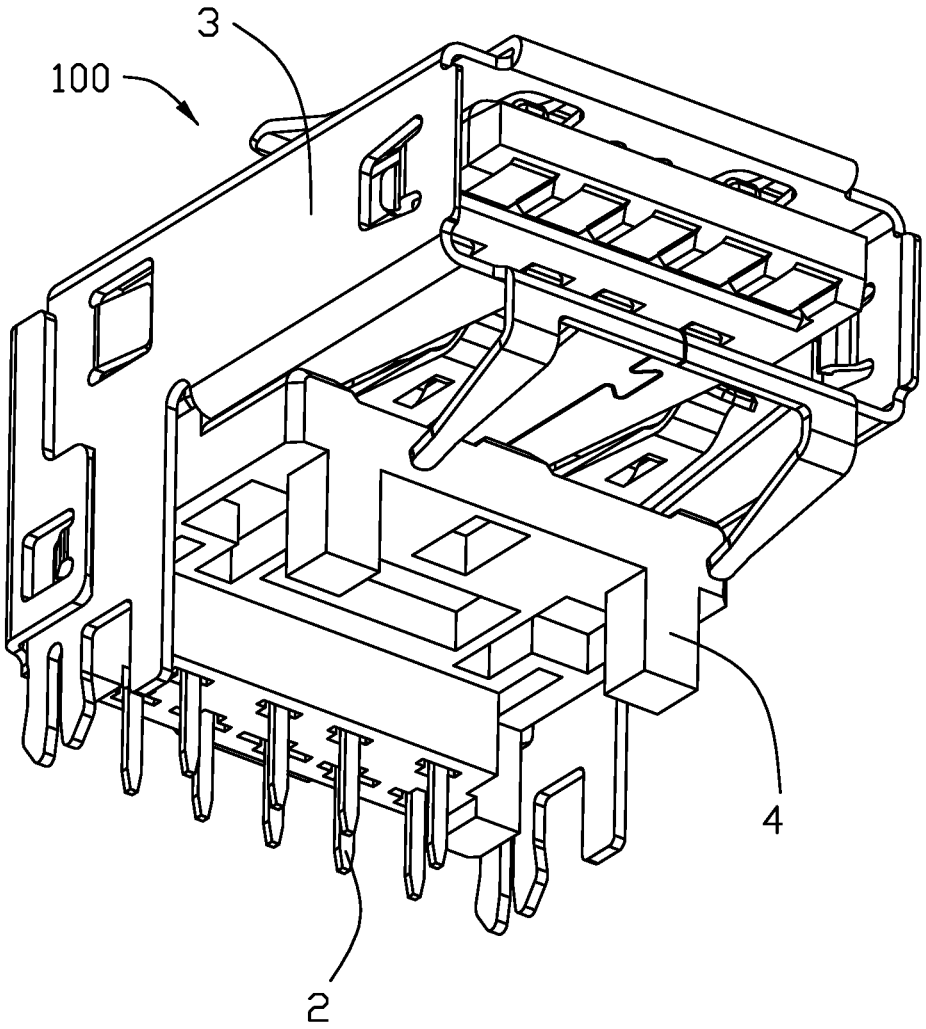
FIG. 2 is another perspective view of the electrical connector of FIG. 1.
Figure 3:
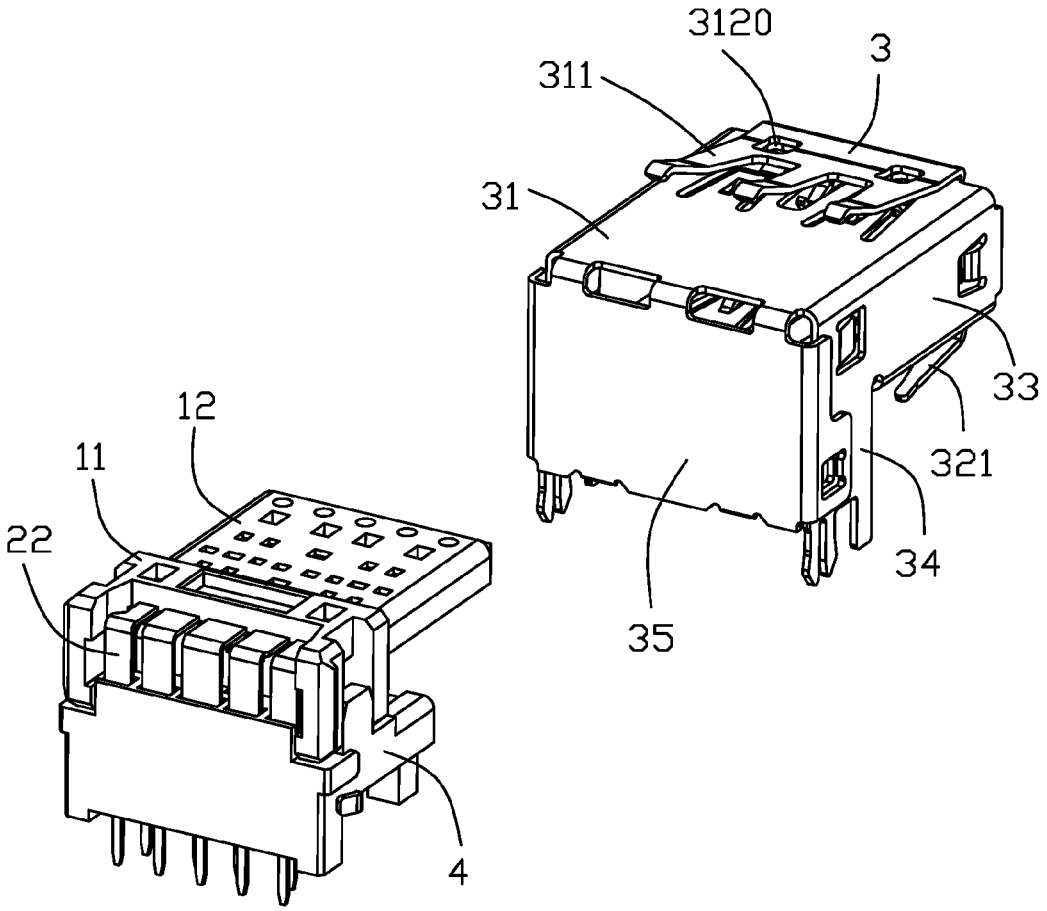
FIG. 3 is an exploded perspective view of the electrical connector of FIG. 1 wherein the rear plate 35 is in a closed position.
Figure 4:
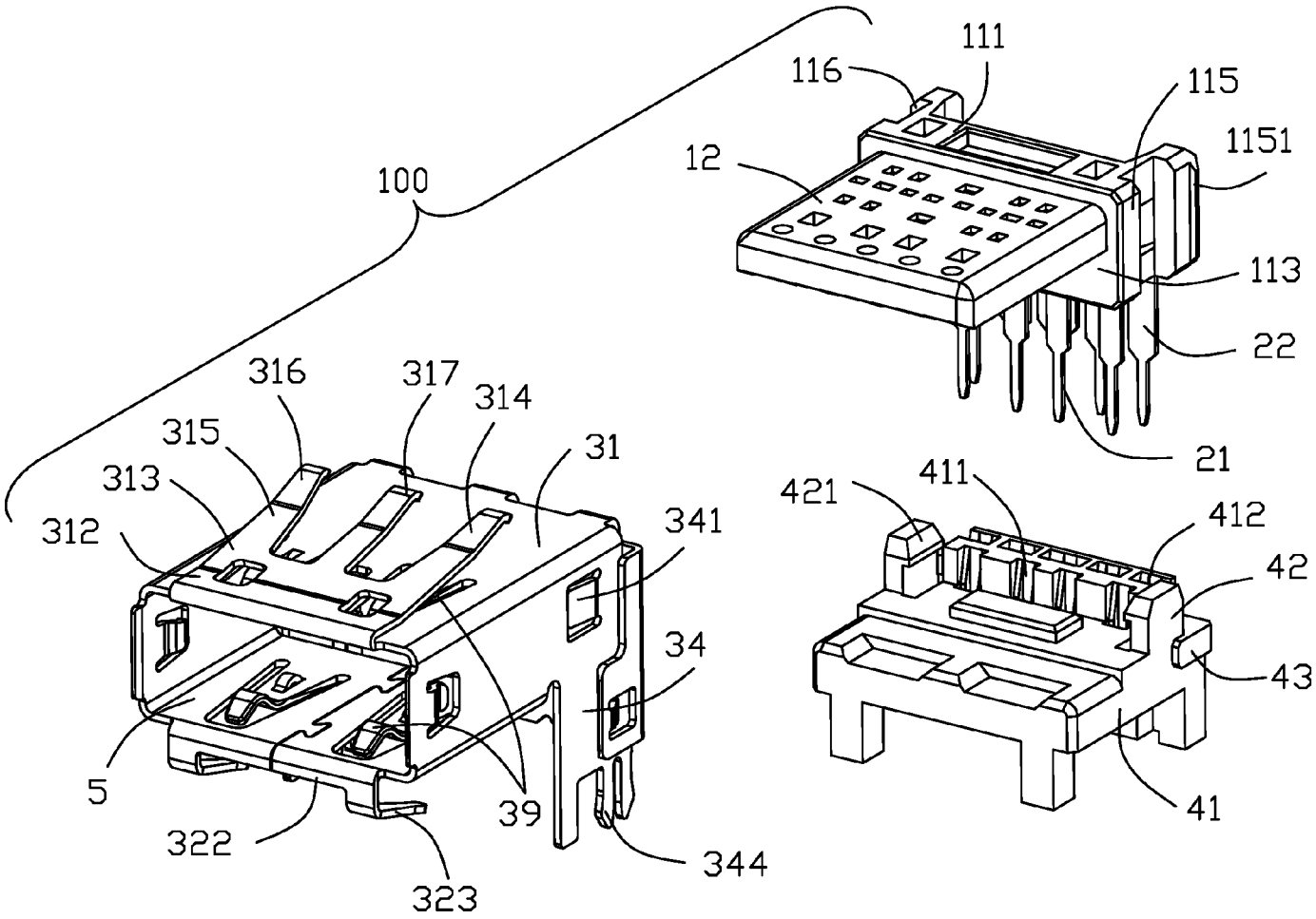
FIG. 4 is a further exploded perspective view of the electrical connector of FIG. 3.
Figure 5:
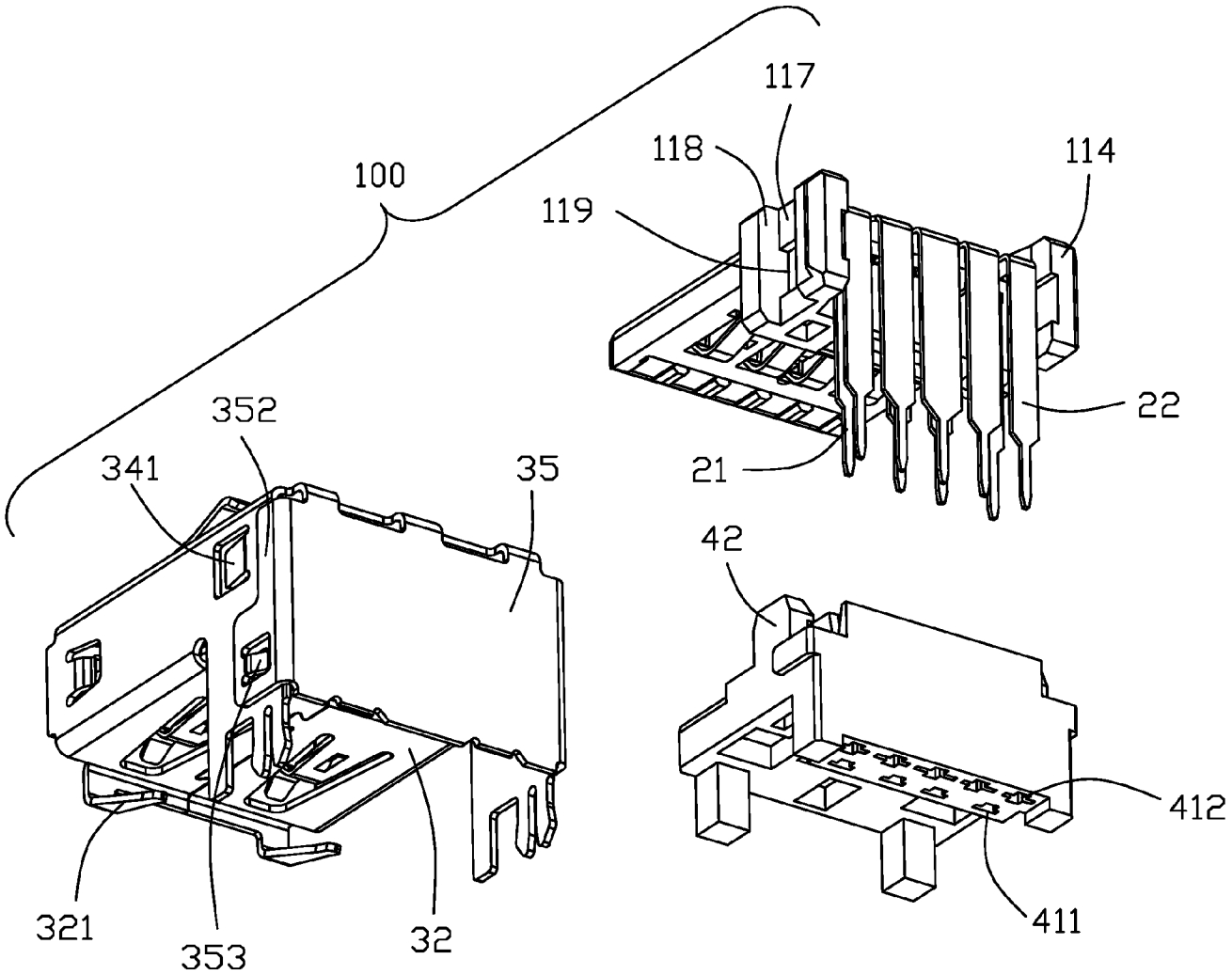
FIG. 5 is another further exploded perspective view of the electrical connector of FIG. 3.
Figure 6:
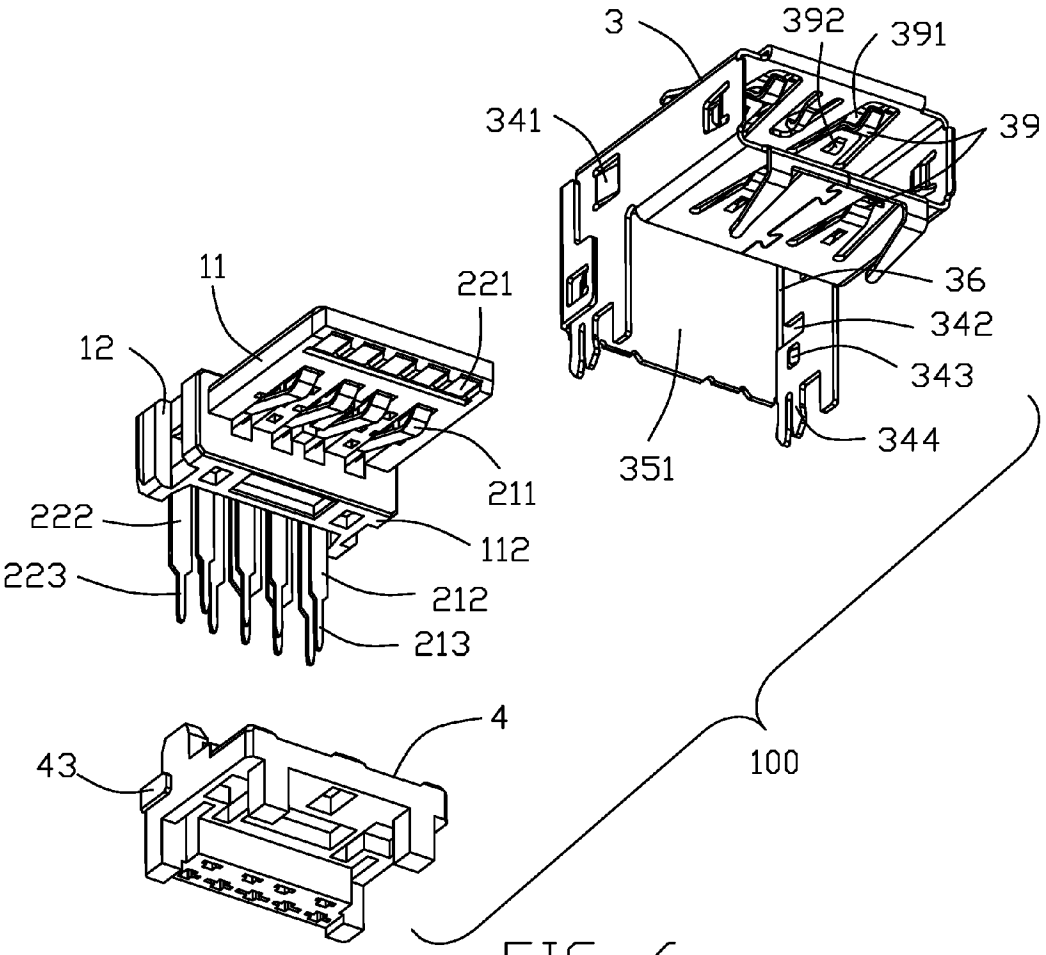
FIG. 6 is another exploded perspective view of the electrical connector of FIG. 3.
Figure 7:
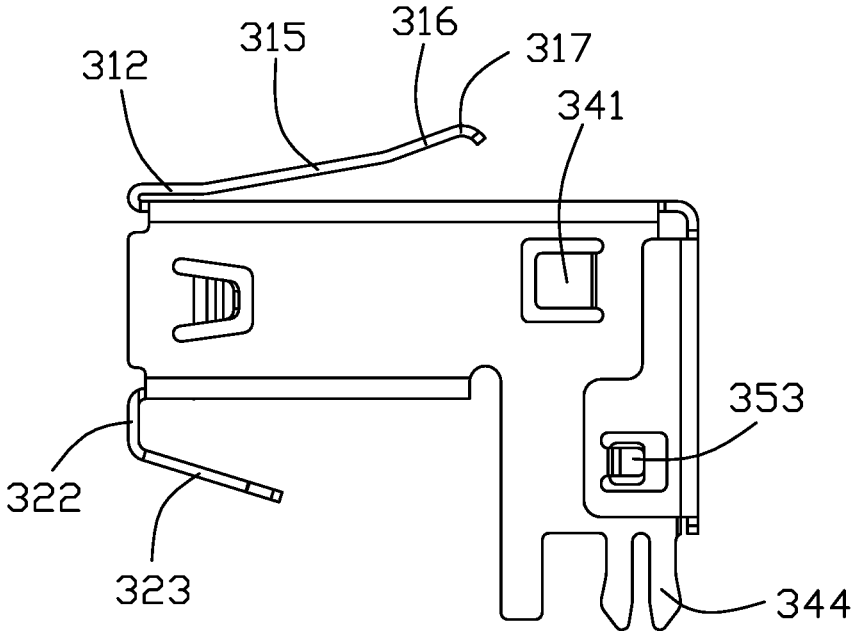
FIG. 7 is a side view of the shell of the electrical connector of FIG. 1.

Reference will now be made in detail to the embodiments of the present disclosure. Referring to FIGS. 1-7, an electrical connector 100 includes an insulative housing 1, a plurality of terminals 2 disposed in the housing 1, a metallic shell enclosing the housing 1, and a spacer attached to the housing 1, wherein the shell forms a mating cavity 5 along the front-to-back direction.

The housing 1 includes a main body 11 and the tongue portion 12 extending forwardly from the main body 11 in the front-to-back direction. The main body 11 includes an upper face 111, a lower face 112 opposite to the upper surface 111 in the vertical direction perpendicular to the front-to-back direction, a front face 113 linking the upper face 111 and the lower face 112, a rear face 114 opposite to the front face 113, and two side faces 115 linking the front face 113 and the rear face 114. The tongue portion 12 extends forwardly from the front face 113. The side face 115 forms the ribs 1151. Then body 111 includes vertical grooves 116 recessed from the corresponding side face 115. The groove 116 includes two side surfaces 118 and the inner surface 117 linking the side surfaces 118. The groove 116 further forms a retention section 119 and extends through the upper face 111 and the lower face 112.

The terminals 2 include first terminals 21 and second terminals 22. The first terminal 21 includes a contacting section 211 exposed upon the lower surface of the tongue portion 12, and a downwardly extending soldering leg 212 exposed under the main body 11. The second terminals 22 are integrally formed with the housing 1, and each second terminal 22 includes the contacting section 221 exposed on the undersurface of the tongue portion 12, and the downwardly extending soldering leg 222. The soldering leg 212 has a soldering end 213 and the soldering leg 222 has a soldering end 223.

The spacer 4 includes a base 41, a plurality of first holes 411 and a plurality of second holes 412 formed in a rear part of the base 41, a pair of retaining blocks 42 on two lateral sides, and a pair of protrusions 43. The soldering legs 212 and the soldering legs 222 are inserted into the corresponding first holes 411 and second holes 412 with the corresponding soldering ends 213 and 223 exposed to an exterior. The retaining blocks 42 includes guiding surfaces 421 for insertion into the corresponding vertical grooves 116 and engaged with the retention section 119 so as to have the spacer 4 attached to the main body 1.

The shell 3 encloses the housing 1 to form a mating cavity 5 for receiving the complementary connector. The shell 3 includes a top plate 31, a bottom plate 32 opposite to the top plate 31, a pair of side plates 33 linked between the top plate 31 and the bottom plate 32. The top plate 31 and the bottom plate 32 include a plurality of spring tangs 39 via a stamping process in a split manner for abutting against the inserted complementary connector. The top plate 31 further includes a first extension 311 which has front stationary/horizontal/base section 312 with openings 3120 therein to communicate with free ends of the corresponding spring tangs 39 in the vertical direction, and a rear deflectable/oblique section extending rearwardly from a rear end of the horizontal section 312. The oblique section includes a base 313 and three spring fingers 314 each having a main part 315, a contacting part 316 with a contacting end 317 for contacting the chassis (not shown). Similarly, the bottom plate 32 includes a second extension 321 having a vertical part 322 and a plurality of spring fingers 323 extending rearwadly and obliquely from a rear side of the vertical part 322. Notably, the two outermost spring fingers 314 are respectively aligned with the spring fingers 323 in the vertical direction while the spring tangs 39 are located between the two outermost spring fingers 314 in the transverse direction perpendicular to the front-to-back direction and the vertical direction.

The shell 3 further includes a retention section 34 extending from the side plates 33, and the rear cover 35 downwardly extending from the rear edge of the top plate 31. The retention section 34 includes a retention tab 341 to be engaged within the vertical groove 116 for fastening the shell 3 to the housing 1. The retention section 34 include a cutout 342 to receive the protrusion 43 for fastening the shell 3 to the spacer 4. The retention section 34 further includes a fixing hole 343 and a mounting leg 344. The rear cover 35 includes a rear plate 351 and a pair of side blade 352. After assembled, a slit 36 is formed between the rear plate 351 and the corresponding retention section 34 to receive the rib 1151 of the housing 1 for enhancing the retention between the shell 3 and the housing 1. The retention tab 353 of the side blade 352 is engaged within the fixing hole 343 of the retention section 34.

Figure 8:
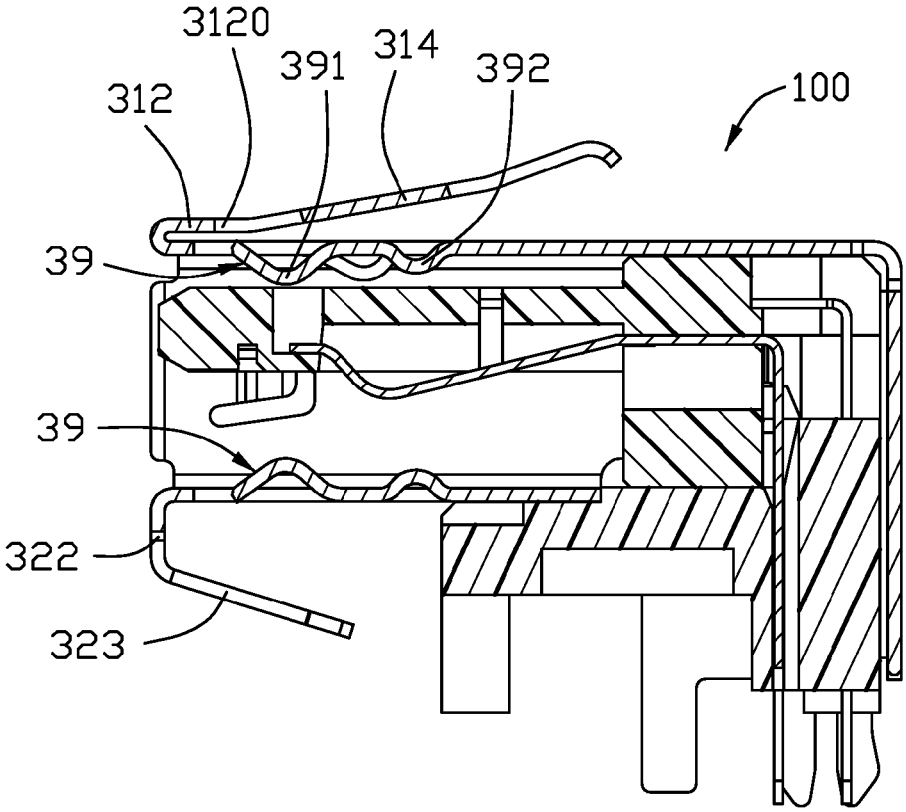
FIG. 8 is a cross-sectional view of the electrical connector of FIG. 1.

Compared with the conventional design, the invention includes the additional first/top extension 311 and the second/bottom extension 321 for resulting in a grounding path for reinforcing the EMI shielding. Another feature of the invention is that in the first extension 311 the front stationary/horizontal section 312 is intimately positioned above the top plate 31 in a folded manner with the deflectable spring fingers 314 extending from the rear edge of the stationary/horizontal section 312, thus assuring superior shielding effect compared with the spring fingers directly extending from a front edge of the top plate in the folded manner as shown in the aforementioned background invention. In addition, referring to FIG. 8, the opening 3120 is provided in the front stationary/horizontal section 312 to accommodate the free end of the corresponding spring tang 39 when the complementary connector is received in the mating cavity 5. It is also noted that the spring tang 39 has a front curved section 391 and a rear curved section 392 inwardly extending into the mating cavity 5 for coupling to the complementary connector received in the mating cavity 5, wherein the front curved section 391 is larger than the rear curved section 392 and is closer to the tongue portion 12 than the rear curved section 392 is for consideration of the different positions in the front-to-back direction. Notably, the spring tangs 39 in the top plate 31 has two larger outer ones extending forwardly and on inner smaller one extending rearward while all spring fingers 314 have the same size and extend rearwardly commonly.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing including a base portion and a tongue portion extending forwardly from the base portion in a front-to-back direction;

a plurality of terminals disposed in the housing with contacting sections exposed upon the tongue portion; and a metallic shell enclosing the housing and forming a mating cavity to surround the tongue portion, said shell including opposite top plate and bottom plate each forming a plurality of spring tangs extending inwardly into the mating cavity via a stamping process in a split manner;

wherein a top extension unitarily extends rearwardly from a front edge of the top plate in a folded manner, and includes a front base section intimately positioned above the top plate, and a rear oblique section extending rearwardly from the front base section and including a plurality of rearwardly and obliquely extending spring fingers away from the top plate in a vertical direction perpendicular to said front-to-back direction;

wherein the front base section extends horizontally parallel to the top plate;

wherein said front base section forms a plurality of openings aligned with front free ends of the corresponding spring tangs in the vertical direction for accommodation consideration;

wherein each of the spring tangs includes a front curved section and a rear curved section, and the front curved section is larger than rear curved section and is closer to the tongue portion than the rear curved section in the vertical direction;

wherein said rear oblique section includes a base from which said rearwardly and obliquely extending spring fingers extend from a rear edge of said base; and wherein the electrical connector further including a bottom extension unitarily extending from a front edge of the bottom plate and including a vertical part and a plurality of spring fingers extending rearwardly and obliquely extending from a lower edge of the vertical part.

2. The electrical connector as claimed in claim 1, wherein each opening occupies both the front base section and the base of the rear oblique section.

3. The electrical connector as claimed in claim 1, wherein the spring fingers of the top extension and those of the bottom extension are aligned with each other in the vertical direction, respectively.

4. The electrical connector as claimed in claim 1, wherein the spring tangs are located between two outermost spring fingers of the top extension in a transverse direction perpendicular to both the front-to-back direction and the vertical direction.

5. An electrical connector comprising:

an insulative housing including a base portion and a tongue portion extending forwardly from the base portion in a front-to-back direction;

a plurality of terminals disposed in the housing with contacting sections exposed upon the tongue portion; and a metallic shell enclosing the housing and forming a mating cavity to surround the tongue portion, said shell including opposite top plate and bottom plate each forming a plurality of spring tangs extending inwardly into the mating cavity via a stamping process in a split manner;

wherein a top extension unitarily extends rearwardly from a front edge of the top plate in a folded manner, and includes a plurality of spring fingers extending rearwardly and obliquely away from the top plate in a vertical direction perpendicular to said front-to-back direction;

wherein a bottom extension unitarily extends rearwardly from a front edge of the bottom plate, and includes a plurality of spring fingers extending rearwardly and obliquely away from the bottom plate;

wherein said spring fingers are not respectively aligned with the spring tangs in the vertical direction but offset from the spring tangs in a transverse direction perpendicular to both said front-to-back direction and said vertical direction;

wherein said top extension includes a front base section from which the corresponding spring fingers unitarily extend rearwardly and obliquely, said front base section intimately confronts the top plate in the vertical direction;

wherein said front base section includes a plurality of openings aligned with free front ends of the corresponding spring tangs in the vertical direction; and wherein said bottom extension unitarily extends from a front edge of the bottom plate and including a vertical part and a plurality of spring fingers extending rearwardly and obliquely extending from a lower edge of the vertical part.

6. The electrical connector as claimed in claim 5, wherein each of the spring tangs includes a front curved section and a rear curved section, and the front curved section is larger than rear curved section and is closer to the tongue portion than the rear curved section in the vertical direction.

7. An electrical connector comprising:

an insulative housing including a base portion and a tongue portion extending forwardly from the base portion in a front-to-back direction;

a plurality of terminals disposed in the housing with contacting sections exposed upon the tongue portion; and a metallic shell enclosing the housing and forming a mating cavity to surround the tongue portion, said shell including opposite top plate and bottom plate each forming a plurality of spring tangs extending inwardly into the mating cavity via a stamping process in a split manner;

wherein a top extension unitarily extends rearwardly from a front edge of the top plate in a folded manner with a plurality of rearwardly and obliquely extending spring fingers away from the top plate in a vertical direction perpendicular to said front-to-back direction;

wherein the spring fingers of the top plate are of a same size and extend rearwardly commonly while the spring tangs in the top plate are of different sizes and extend rearwardly and forwardly respectively;

wherein each of the spring tangs includes a front curved section and a rear curved section, and the front curved section is larger than rear curved section and is closer to the tongue portion than the rear curved section in the vertical direction;

wherein said top extension includes a front base section from which the corresponding spring fingers unitarily extend rearwardly and obliquely, said front base section intimately confronts the top plate in the vertical direction; and wherein said front base section includes a plurality of openings aligned with free front ends of the corresponding spring tangs in the vertical direction.

8. The electrical connector as claimed in claim 7, wherein said spring fingers are not respectively aligned with the spring tangs in the vertical direction but offset from the spring tangs in a transverse direction perpendicular to both said front-to-back direction and said vertical direction.

* * * * *